US011674664B2

(12) United States Patent
Yang

(10) Patent No.: US 11,674,664 B2
(45) Date of Patent: Jun. 13, 2023

(54) PORTABLE LAMP

(71) Applicant: Xue Yang, Guangdong (CN)

(72) Inventor: Xue Yang, Guangdong (CN)

(73) Assignee: Shenzhen Ke Fu Co., Ltd., Shenzhen (CN)

( * ) Notice: Subject to any disclaimer, the term of this patent is extended or adjusted under 35 U.S.C. 154(b) by 0 days.

(21) Appl. No.: 18/068,533

(22) Filed: Dec. 20, 2022

(65) Prior Publication Data

US 2023/0118931 A1 Apr. 20, 2023

(51) Int. Cl.

| | |
|---|---|
| ***F21L 4/04*** | (2006.01) |
| ***F21V 1/06*** | (2006.01) |
| ***F21V 1/14*** | (2006.01) |
| ***F21V 15/01*** | (2006.01) |
| ***F21V 23/00*** | (2015.01) |
| *F21W 111/10* | (2006.01) |

(52) U.S. Cl.
CPC ..... *F21V 1/14* (2013.01); *F21L 4/04* (2013.01); *F21V 15/012* (2013.01); *F21V 23/007* (2013.01); *F21V 1/06* (2013.01); *F21W 2111/10* (2013.01)

(58) Field of Classification Search
CPC ..... F21L 4/04; F21V 1/06; F21V 1/0814; F21V 1/143; F21V 1/146; F21V 15/012; F21W 2111/10
See application file for complete search history.

(56) References Cited

U.S. PATENT DOCUMENTS

| | | | | |
|---|---|---|---|---|
| 6,186,640 | B1 * | 2/2001 | Typaldos | A45C 3/06 150/124 |
| 7,857,490 | B1 * | 12/2010 | Fett | F21V 3/026 362/351 |
| 10,156,342 | B2 * | 12/2018 | Haskal | F21V 7/00 |
| 10,234,116 | B2 * | 3/2019 | Maguire | F21V 21/406 |
| 10,359,173 | B2 * | 7/2019 | Chun | F21V 3/02 |
| 10,584,840 | B2 * | 3/2020 | Ashmore | F21V 29/70 |

FOREIGN PATENT DOCUMENTS

KR 2015000256 U * 1/2015

* cited by examiner

*Primary Examiner* — Sean P Gramling

(57) ABSTRACT

A lamp is portable and provided. The lamp includes an adjustable lamp body; a lamp control assembly; and a lamp positioning mechanism. The adjustable lamp body is arranged on the lamp control assembly, and the lamp control assembly is arranged inside the lamp positioning mechanism. The adjustable lamp body includes at least one folding part, and the folding part includes two symmetrically arranged outer folding parts and two symmetrically arranged inner folding parts. The inner folding parts are respectively arranged between two ends of each outer folding part. The lamp control assembly includes a control box and a positioning plate respectively arranged at both ends of the adjustable lamp body. There are further provided a lamp belt and a handle body. The control box can adjust and position an angle through the handle body.

10 Claims, 15 Drawing Sheets

PORTABLE LAMP

FIELD OF THE INVENTION

The invention relates to lamps and more particularly to a portable lamp having improved characteristics.

BACKGROUND OF THE INVENTION

Lamps refer to the devices that can transmit and distribute light and change the light distribution of light sources, comprising all parts and assemblies required for fixing and protecting the light sources, as well as the wires necessary for connecting with the power supply. With the continuous development of society, portable lamps, emergency lamps, ceiling lamps, desk lamps and other lamps are born.

In the conventional art, most of the portable lamps on the market are in a fixed structure. Whether used on the desktop or in hand, these portable lamps only have a single shape, which is less ornamental. In addition, because of the fixed structure, when not in use, the lamps used on the desktop or in hand occupy a big space, which cannot meet the user's needs.

Thus, the need for improvement still exists.

SUMMARY OF THE INVENTION

The invention provides the following technical solution to solve the problems above: a portable lamp comprises an adjustable lamp body, a lamp control assembly and a lamp positioning mechanism, wherein the adjustable lamp body is arranged on the lamp control assembly, and the lamp control assembly is arranged inside the lamp positioning mechanism.

The adjustable lamp body comprises at least one folding part, and the folding part comprises two symmetrically arranged outer folding parts I and inner folding parts I. The two inner folding parts are respectively arranged between the two ends of the two outer folding parts.

The lamp control assembly comprises a control box and a positioning plate respectively arranged at both ends of the adjustable lamp body. A lamp belt of which one end extends to the interior of the adjustable lamp body is arranged in the control box.

The lamp positioning mechanism comprises a handle body. The two sides of the inner wall of the handle body are provided with positioning assemblies which are respectively connected to both ends of the control box. In this way, the control box adjusts and positions the angle through the handle body.

As a preferred technical solution of the invention, a plurality of the folding parts are combined with the lamp control assembly to form a ring shape. Two adjacent outer folding parts I are combined to form an inner folding part II, and two adjacent inner folding parts I are combined to form an outer folding part II.

As a preferred technical solution of the invention, the end of the lamp belt far from the control box runs through the adjustable lamp body and is connected to one side of the positioning plate.

As a preferred technical solution of the invention, a rechargeable battery and a control board electrically connected to the rechargeable battery are arranged inside the control box, the control box is provided with a charging interface electrically connected to the control board, and the end of the lamp belt far from the positioning plate is fixedly arranged on the control board.

As a preferred technical solution of the invention, the positioning assembly comprises a connecting pin fixedly arranged on both ends of the control box and a rubber tube embedded on both sides of the inner wall of the handle body. The end of the connecting pin far from the end of the control box extends to the inside of the rubber tube and is movably sleeved with the inside of the rubber tube.

As a preferred technical solution of the invention, the handle body is U-shaped, and the side of the positioning plate far from the lamp belt is fitted with one side of the control box.

As a preferred technical solution of the invention, the positioning plate and the control box are made of wood, metal, magnetic or plastic material.

As a preferred technical solution of the invention, the top of the inner wall of the handle body is provided with a metal boss for adsorption with the positioning plate.

As a preferred technical solution of the invention, the control box is a polygon, and beveled edges are arranged on both sides of the top of the handle body. The shape of the top of the inner wall of the handle body matches the shape of the top of the control box.

As a preferred technical solution of the invention, the folding part is made of PVC, cardboard, cloth or TYVEK material. The handle body is made of wood, metal or plastic material.

Compared with the conventional art, the invention provides a portable lamp, which has the following advantages:

Among the adjustable lamp body, lamp control assembly and lamp positioning mechanism, the lamp positioning mechanism adjusts the angle of the control box, and then adjusts the position of the positioning plate, so that different shapes of the adjustable lamp body can be switched. Different from the common portable lamps on the market, the invention has various shapes. When not in use, the product can be folded to a very small size. The invention has the advantages of small space occupation, more portable use, simple and compact structure, good economic benefits and broad application prospects.

The above and other objects, features and advantages of the invention will become apparent from the following detailed description taken with the accompanying drawings

DETAILED DESCRIPTION OF THE INVENTION

Figure 1:
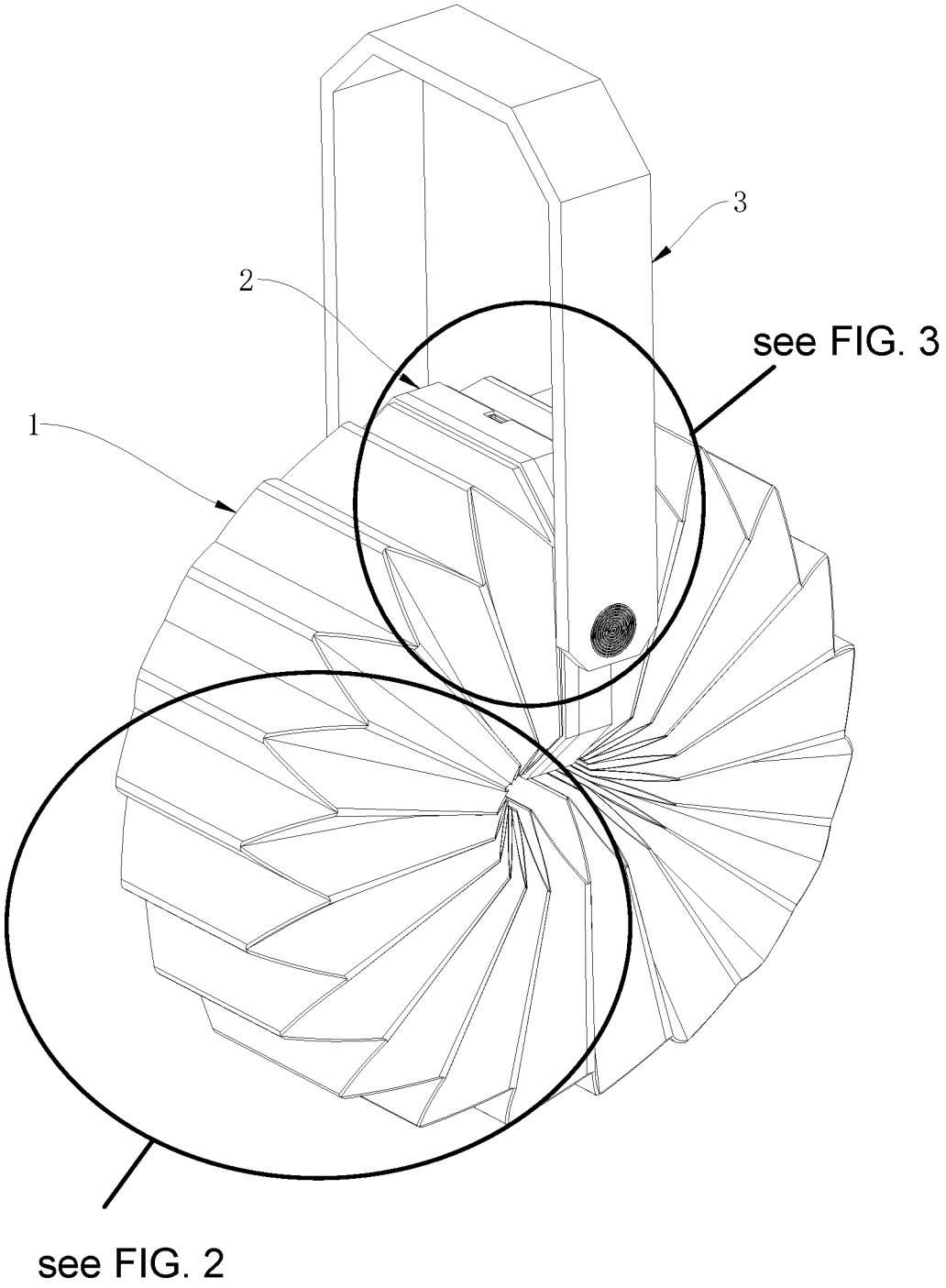
FIG. 1 is a perspective view of a portable lamp of the invention showing a first configuration thereof.
Figure 2:
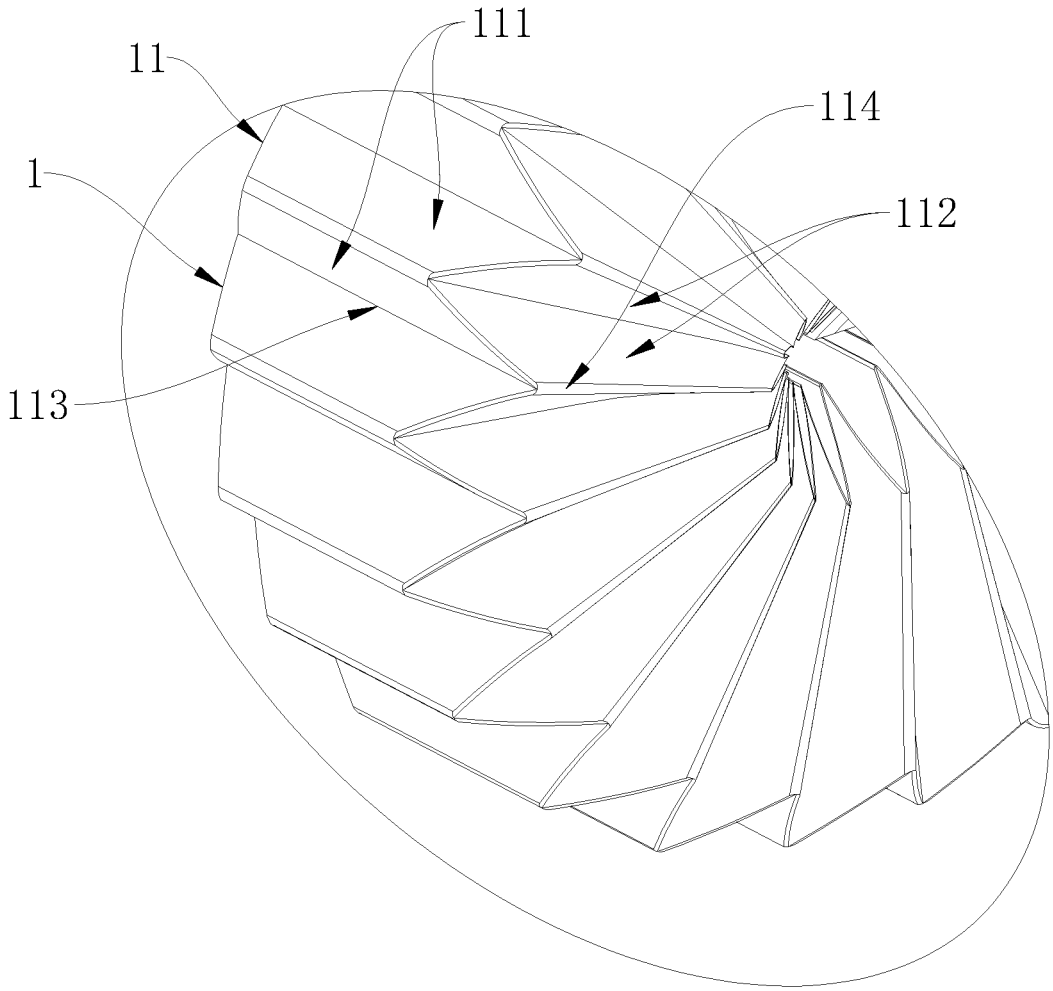
FIG. 2 is a detailed view of the folding part of the portable lamp in FIG. 1.
Figure 3:
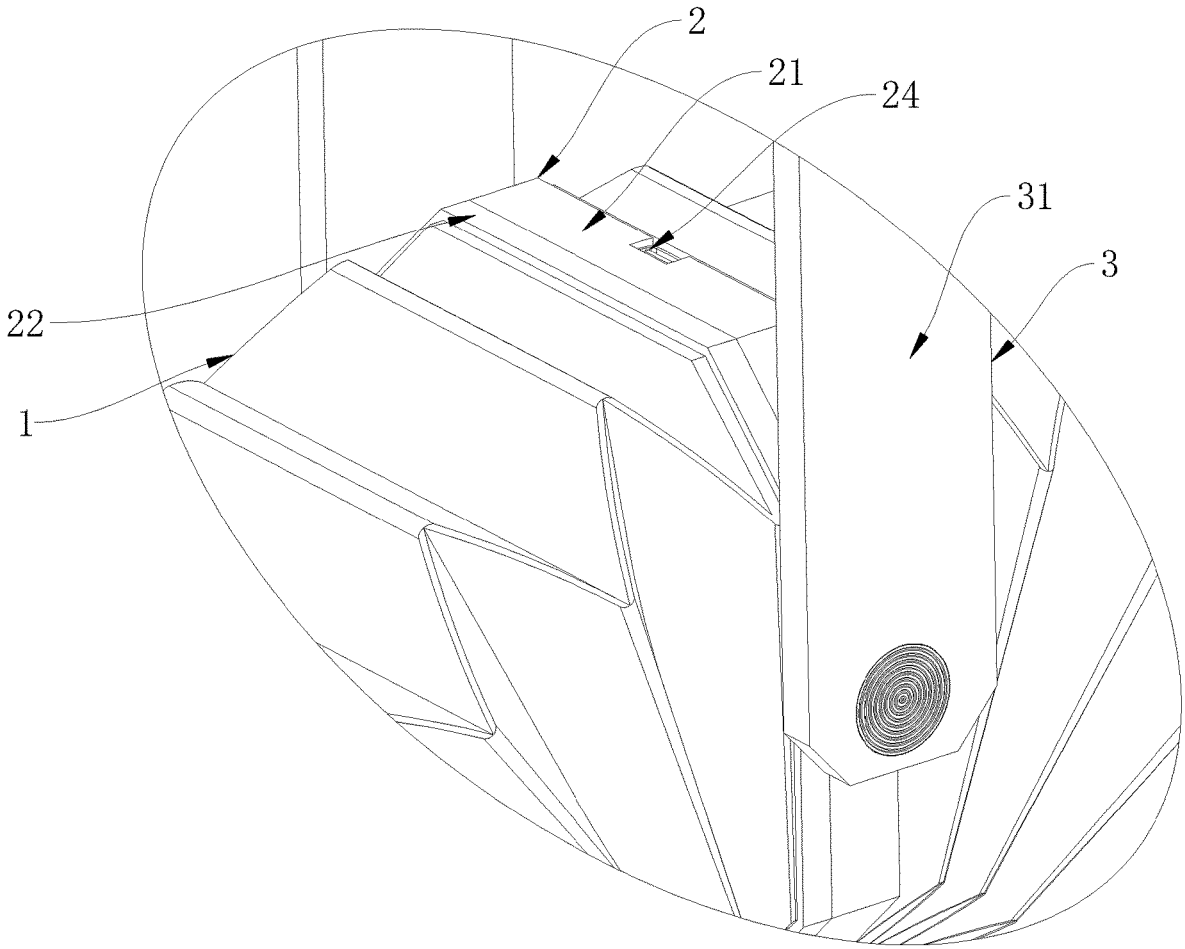
FIG. 3 is a detailed view of the control box of the portable lamp in FIG. 1.
Figure 4:
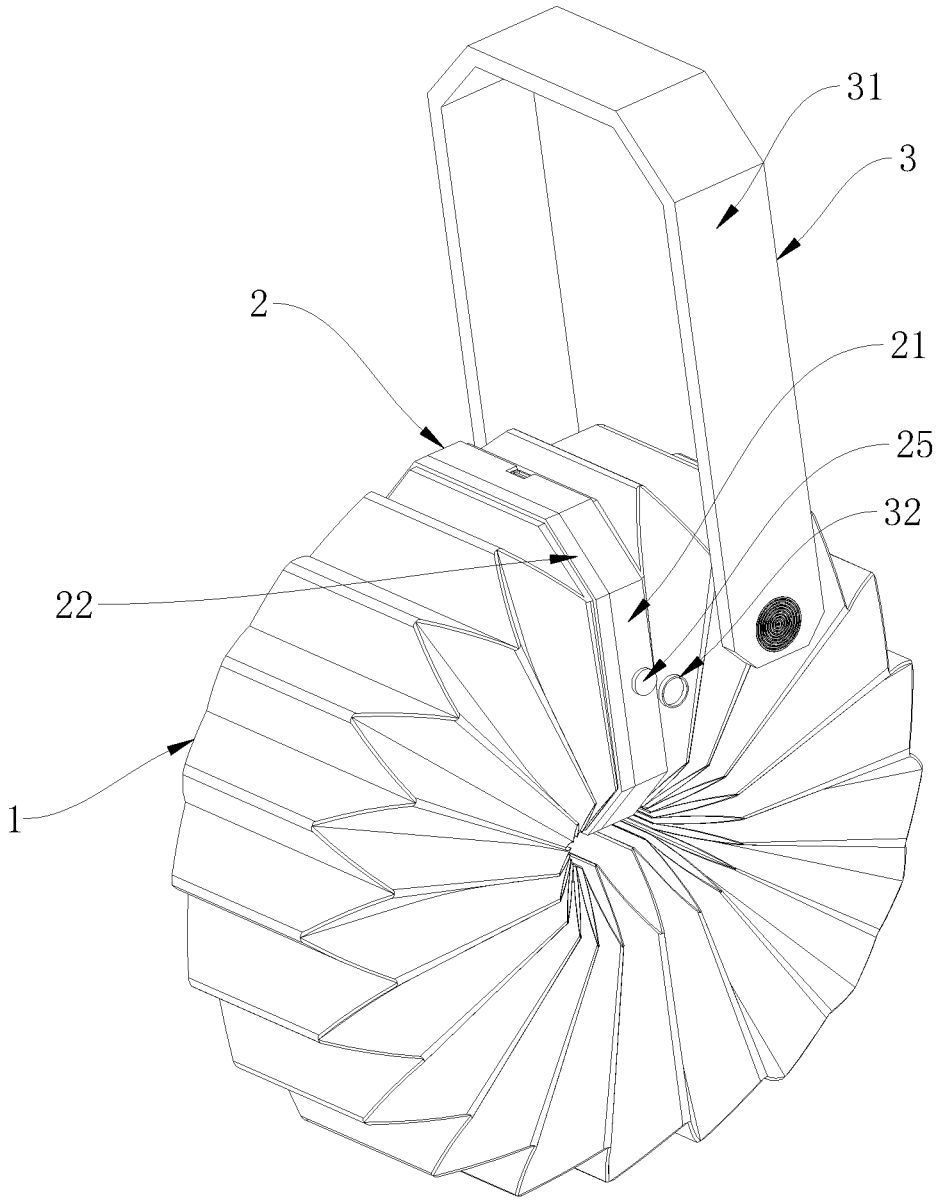
FIG. 4 is an exploded, perspective view of the portable lamp showing the positioning assembly structure being disengaged from the portable lamp.
Figure 5:
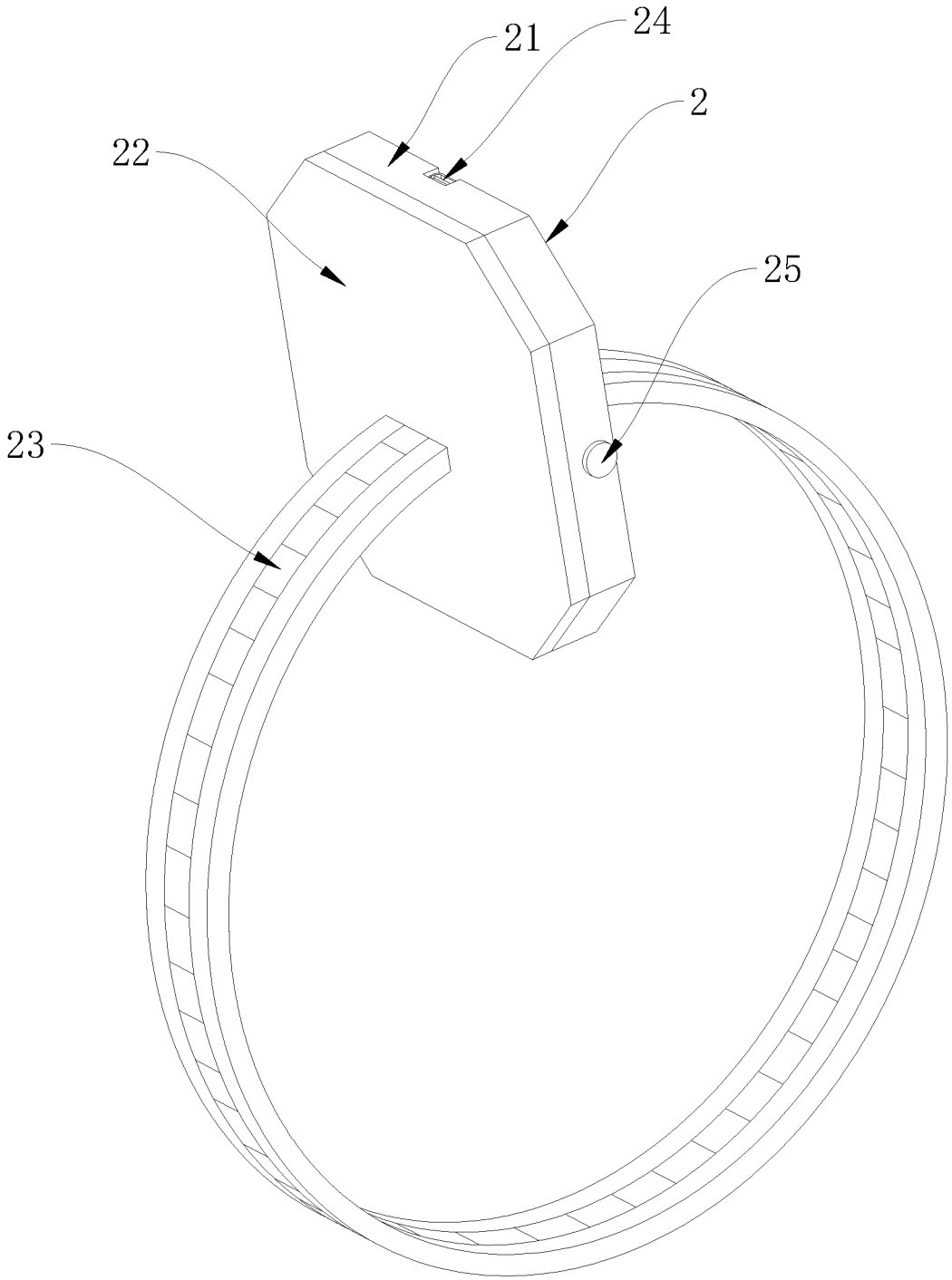
FIG. 5 is a perspective view of the lamp belt of the portable lamp.
Figure 6:
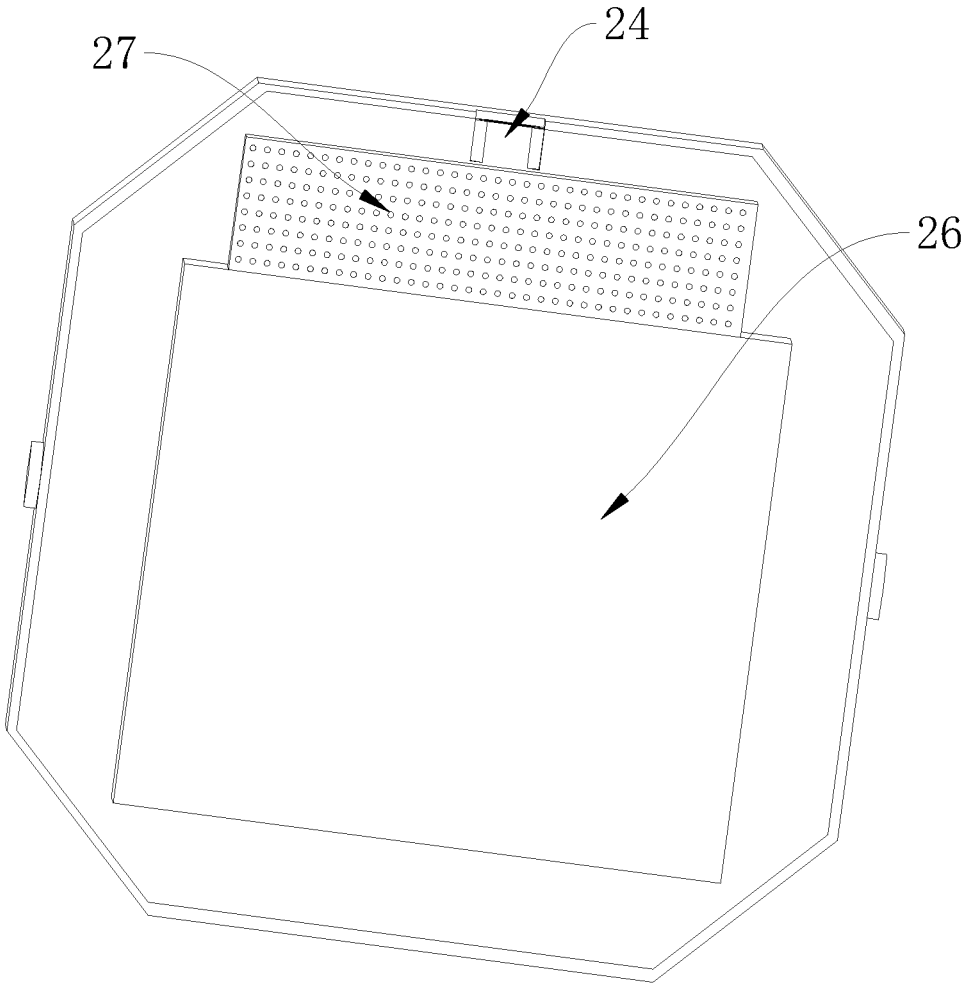
FIG. 6 is a plan view showing inside of the control box.

The technical solutions in an embodiment of the invention will be clearly and completely described in combination with the following drawings of the embodiment. Obviously, the described embodiment is only a part but not all of the embodiments of the invention. All other embodiments obtained by ordinary persons skilled in the art based on the shown embodiment of the invention without doing any creative work shall belong to the scope of protection of the invention.

As shown in FIGS. 1 to 6, a first configuration of a portable lamp of the invention is shown. The portable lamp comprises an adjustable lamp body 1, a lamp control assembly 2 and a lamp positioning mechanism 3, wherein the adjustable lamp body 1 is arranged on the lamp control assembly 2, and the lamp control assembly 2 is arranged inside the lamp positioning mechanism 3.

The adjustable lamp body 1 comprises at least one folding part 11, and the folding part 11 comprises two symmetrically arranged outer folding parts I 111 and inner folding parts I 112. The two inner folding parts are respectively arranged between the two ends of each of the two outer folding parts.

The lamp control assembly 2 comprises a control box 21 and a positioning plate 22 respectively arranged at both ends of the adjustable lamp body 1. A lamp belt 23 of which one end extends to the interior of the adjustable lamp body 1 is arranged in the control box 21.

The lamp positioning mechanism 3 comprises a handle body 31. The two sides of the inner wall of the handle body 31 are provided with positioning assemblies which are respectively connected to both ends of the control box 21. In this way, the control box 21 adjusts and positions the angle through the handle body 31.

As a specific technical solution of the first configuration, a plurality of the folding parts 11 are combined with the lamp control assembly 2 to form a ring shape. Two adjacent outer folding parts I 111 are combined to form an inner folding part II 113, and two adjacent inner folding parts I 112 are combined to form an outer folding part II 114. The outer folding part I 111 and the inner folding part I 112 form a folding part 11, and the outer folding part II 114 and the inner folding part II 113 are formed between the two adjacent folding parts 11. In this way, the adjustable lamp body 1 composed of a plurality of folding parts 11 can be folded to a very small size, which is convenient for carrying, and can also be expanded to different shapes for users to get their needs.

As a specific technical solution of the first configuration, the end of the lamp belt 23 far from the control box 21 runs through the adjustable lamp body 1 and is connected to one side of the positioning plate 22. the two ends of the lamp belt 23 are connected to the control box 21 and the positioning plate 22 respectively, ensuring the stability of the lamp belt 23. When the adjustable lamp body 1 is unfolded, the light of the adjustable lamp body 1 is more uniform and there is not any dark light area.

As a specific technical solution of the first configuration, a rechargeable battery 26 and a control board 27 electrically connected to the rechargeable battery 26 are arranged inside the control box 21, the control box 21 is provided with a charging interface 24 electrically connected to the control board 27, and the end of the lamp belt 23 far from the positioning plate 22 is fixedly arranged on the control board 27. An inductive switch is arranged on the control board 27. When the positioning plate 22 is close to the control box 21 and the adjustable lamp body 1 is folded to the minimum size, the lamp belt 23 automatically turns off. When the adjustable lamp body 1 is unfolded, the lamp belt 23 lights up automatically.

As a specific technical solution of the first configuration, the positioning assembly comprises a connecting pin 25 fixedly arranged on both ends of the control box 21 and a rubber tube 32 embedded on both sides of the inner wall of the handle body 31. The end of the connecting pin 25 far from the end of the control box 21 extends to the inside of the rubber tube 32 and is movably sleeved with the inside of the rubber tube 32. A big friction force will be generated between the rubber tube 32 and the connecting pin 25, making the connecting pin 25 suffer from resistance in rotation. At the same time, the connecting pin 25 remains positioned without any external force, so as to support the adjustable lamp body 1 in various shapes.

As a specific technical solution of the first configuration, the handle body 31 is U-shaped, and the side of the positioning plate 22 far from the lamp belt 23 is fitted with one side of the control box 21. The U-shaped handle body 31 is convenient for the user to hold, and the positioning plate 22 is fitted with the control box 21, so that the adjustable lamp body 1 can be unfolded in a ring shape.

As a specific technical solution of the first configuration, the positioning plate 22 and the control box 21 are made of wood, metal, magnetic or plastic material. The positioning plate 22 and the control box 21 need to be adsorbed together when the positioning plate 22, the control box 21 and the adjustable lamp body 1 form a ring shape. When the control box 21 and the positioning plate 22 are made of wood, metal or plastic, magnetic blocks need to be embedded on the sides where the control box 21 and the positioning plate 22 fit to achieve a stable connection between the control box 21 and the positioning plate 22. When the control box 21 and the positioning plate 22 are made of a metal material, the magnetic blocks only need to be embedded on the control box 21 or the positioning plate 22.

As a specific technical solution of the first configuration, the top of the inner wall of the handle body 31 is provided with a metal boss 33 for adsorption with the positioning plate 22. The metal boss 33 is used to adsorb with the positioning plate 22 and adapt to the adjustable lamp body 1 of different shapes. When there is not any embedded magnetic block in the positioning plate 22, the metal boss 33 needs to be made of a magnetic material to realize the connection between the positioning plate 22 and the metal boss 33.

As a specific technical solution of the first configuration, the control box 21 is a polygon, and beveled edges 34 are arranged on both sides of the top of the handle body 31. The shape of the top of the inner wall of the handle body 31 matches the shape of the top of the control box 21. The handle body 31 and the control box 21 are polygons. The beveled edges 34 are arranged on the handle body 31 to adapt to the shapes of the control box 21 and the positioning plate 22, so as to make the product appearance beautiful. Besides polygons, the control box 21 and the positioning plate 22 can also be circular or curved. When the control box 21 and the positioning plate 22 are circular or curved, the shape inside the handle body 31 also needs to be adaptively changed.

As a specific technical solution of the first configuration, the folding part 11 is made of PVC, cardboard, cloth or TYVEK material. The handle body 31 is made of wood, metal or plastic material. The folding part 11 can be made of PVC, cardboard, cloth or TYVEK material. TYVEK material is preferred due to its balanced physical properties, thin thickness, light weight, low surface friction and large elasticity, and it is not easy to deform, but soft and smooth, tough, tear resistant, opaque, moisture resistant and water stain resistant. In addition, TYVEK material combines the characteristics of paper, cloth, and film to ensure the service performance of the adjustable lamp body 1.

Figure 7:
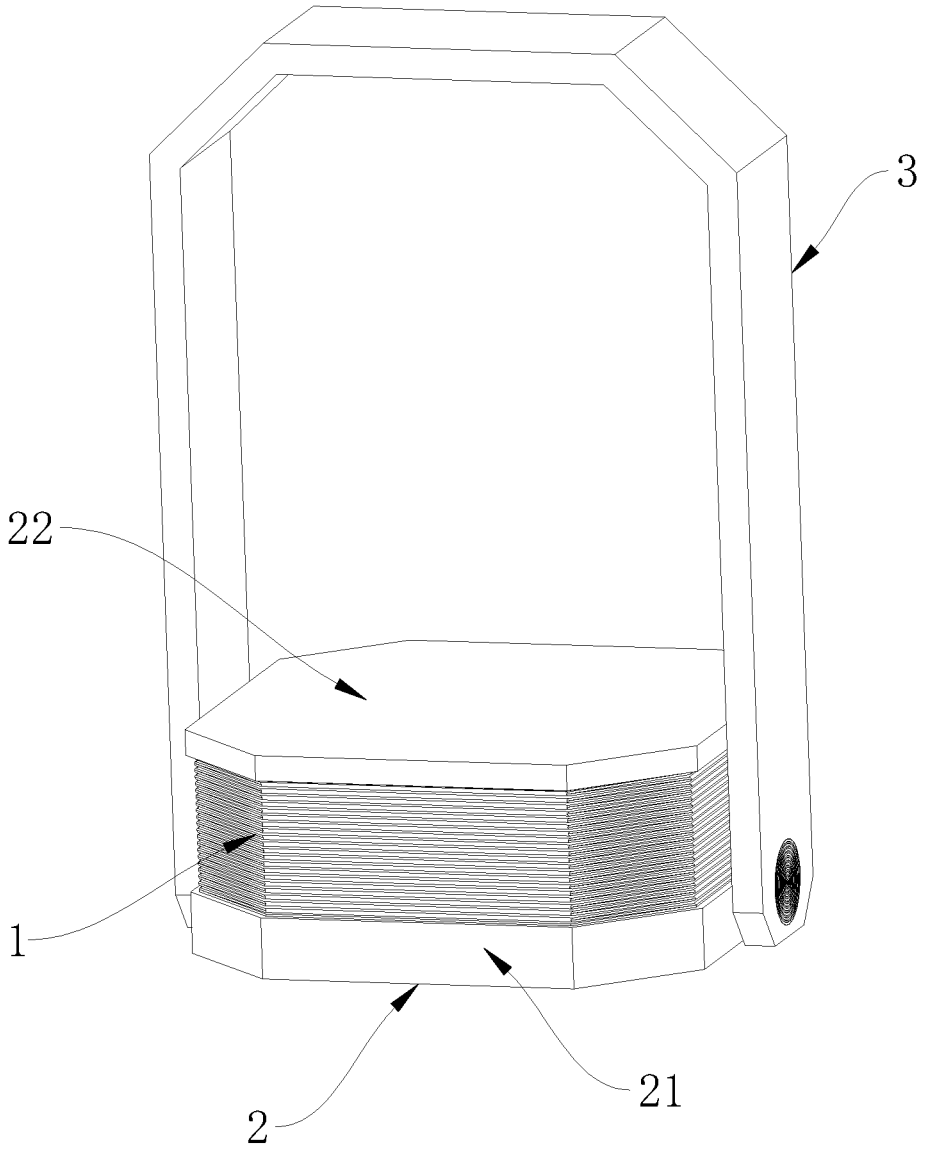
FIG. 7 is a perspective view of the portable lamp showing a second configuration thereof.

A second configuration of the portable lamp is shown in FIG. 7. When not in use, the positioning plate 22 is separated from the control box 21, the adjustable lamp body 1 is folded to the minimum size, and the control box 21 is turned over to accommodate the positioning plate 22 and the adjustable lamp body 1 in the handle body 31.

Figure 8:
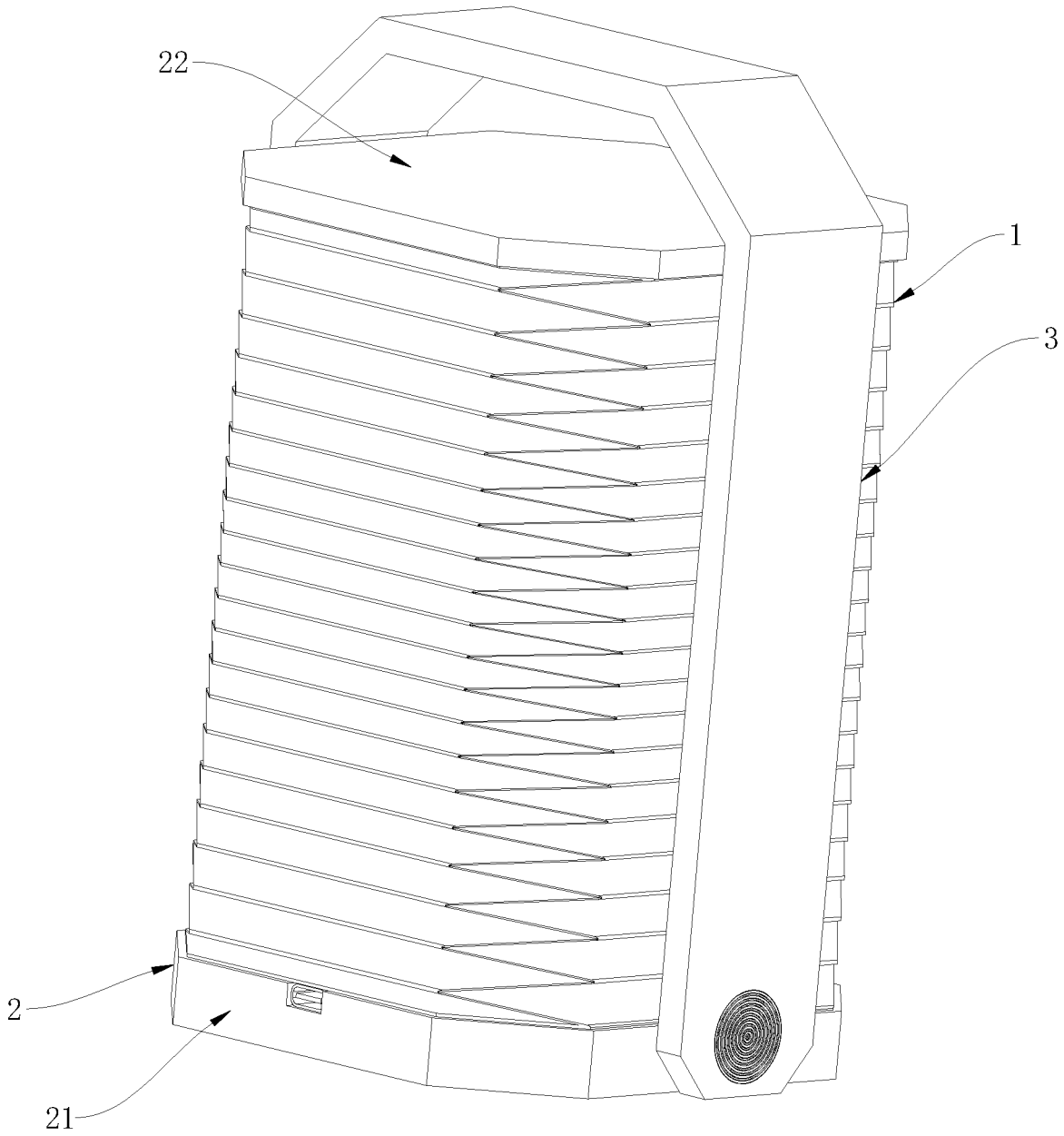
FIG. 8 is a perspective view of the portable lamp showing a third configuration thereof.

A third configuration of the portable lamp is shown in FIG. 8. The positioning plate 22 is pulled to drive the adjustable lamp body 1 to unfold, and then the interior lamp belt 23 is lit. The user can adjust the adjustable lamp body 1 to the desired shape.

Figure 9:
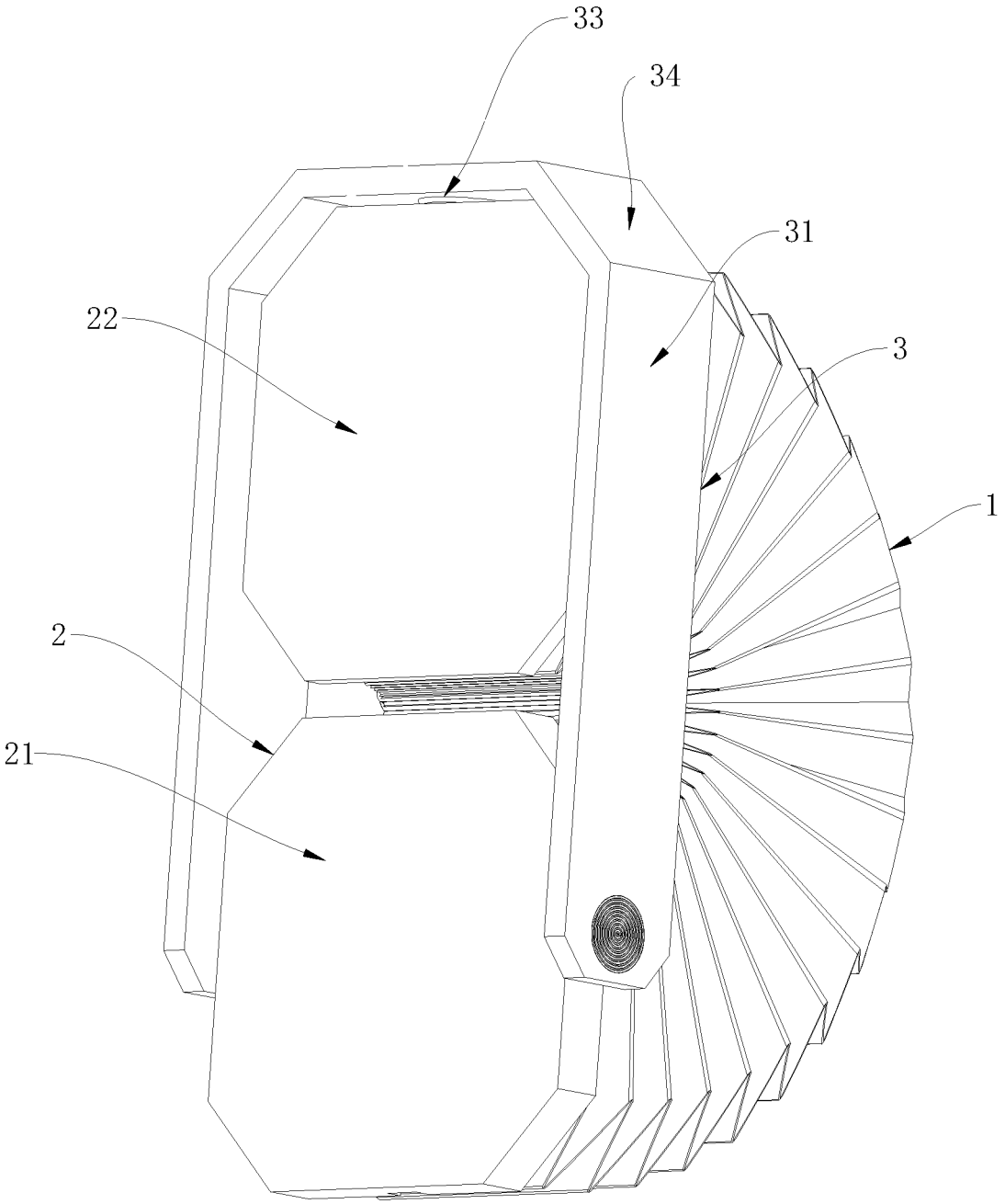
FIG. 9 is a perspective view of the portable lamp showing a fourth configuration thereof.

A fourth configuration of the portable lamp is shown in FIG. 9. FIG. 9 shows the adjustable lamp body 1 adjusted to a semicircular shape. It only needs to adsorb the positioning plate 22 and the metal boss 33 to maintain the positioning.

Figure 10:
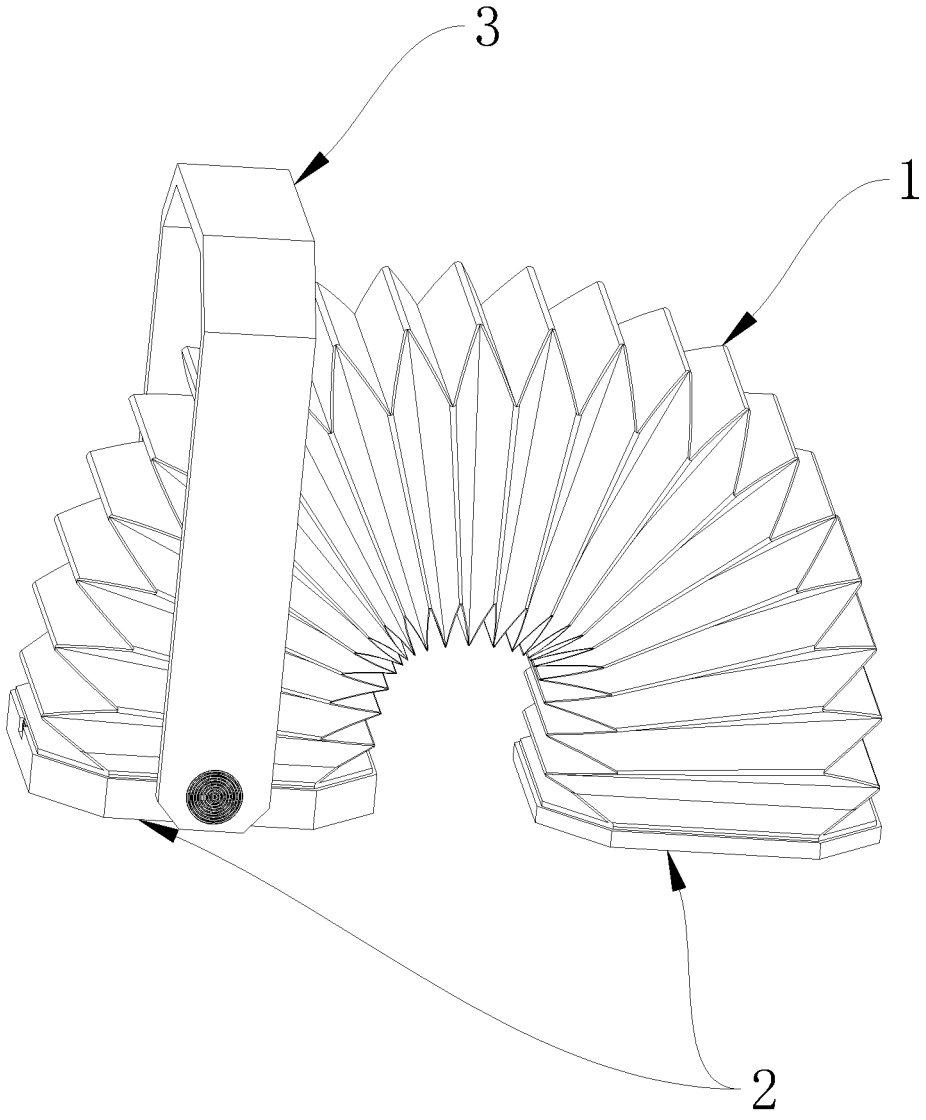
FIG. 10 is a perspective view of the portable lamp showing a fifth configuration thereof.
Figure 11:
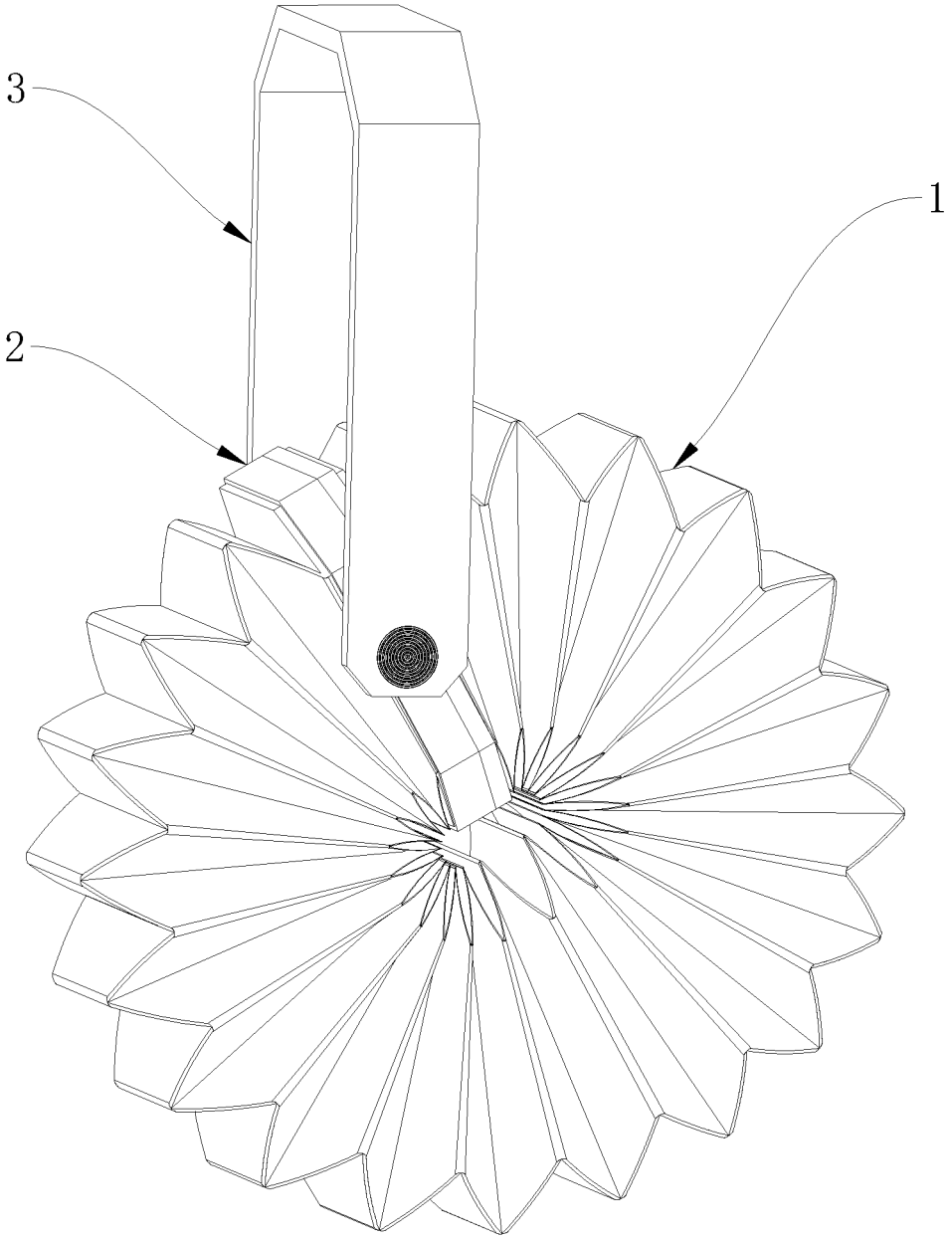
FIG. 11 is a perspective view of the portable lamp showing a sixth configuration thereof.
Figure 12:
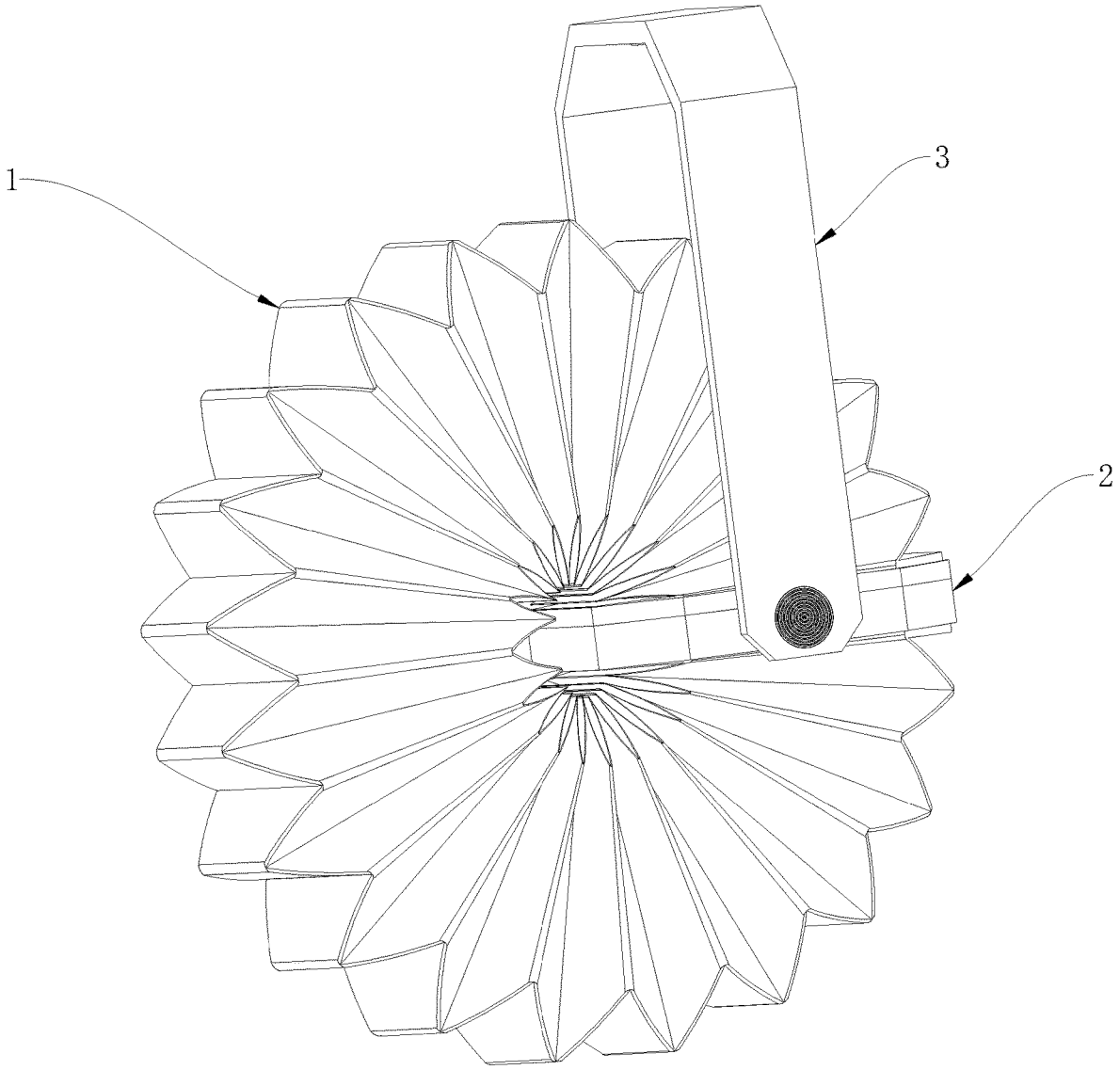
FIG. 12 is a perspective view of the portable lamp showing a seventh configuration thereof.
Figure 13:
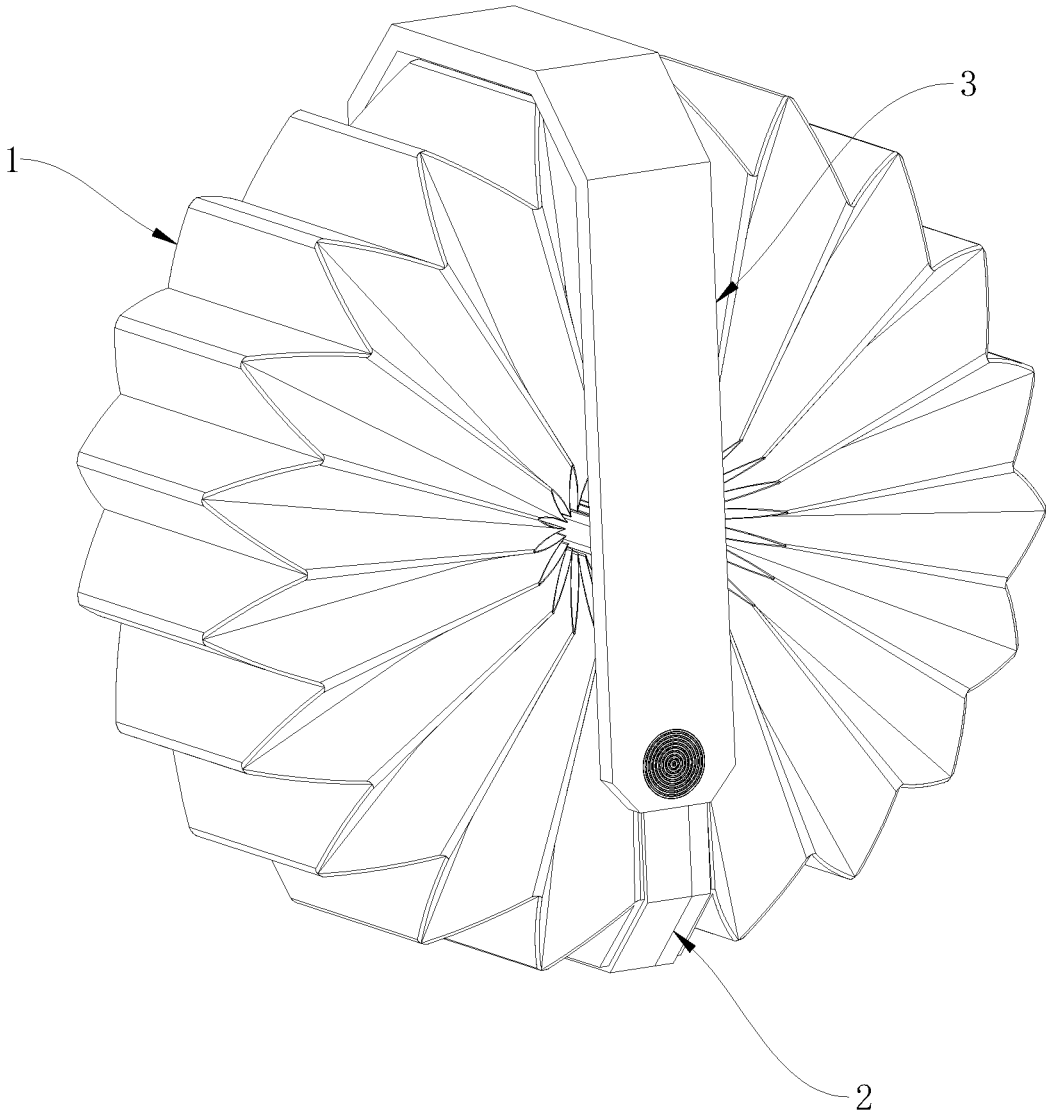
FIG. 13 is a perspective view of the portable lamp showing an eighth configuration thereof.
Figure 14:
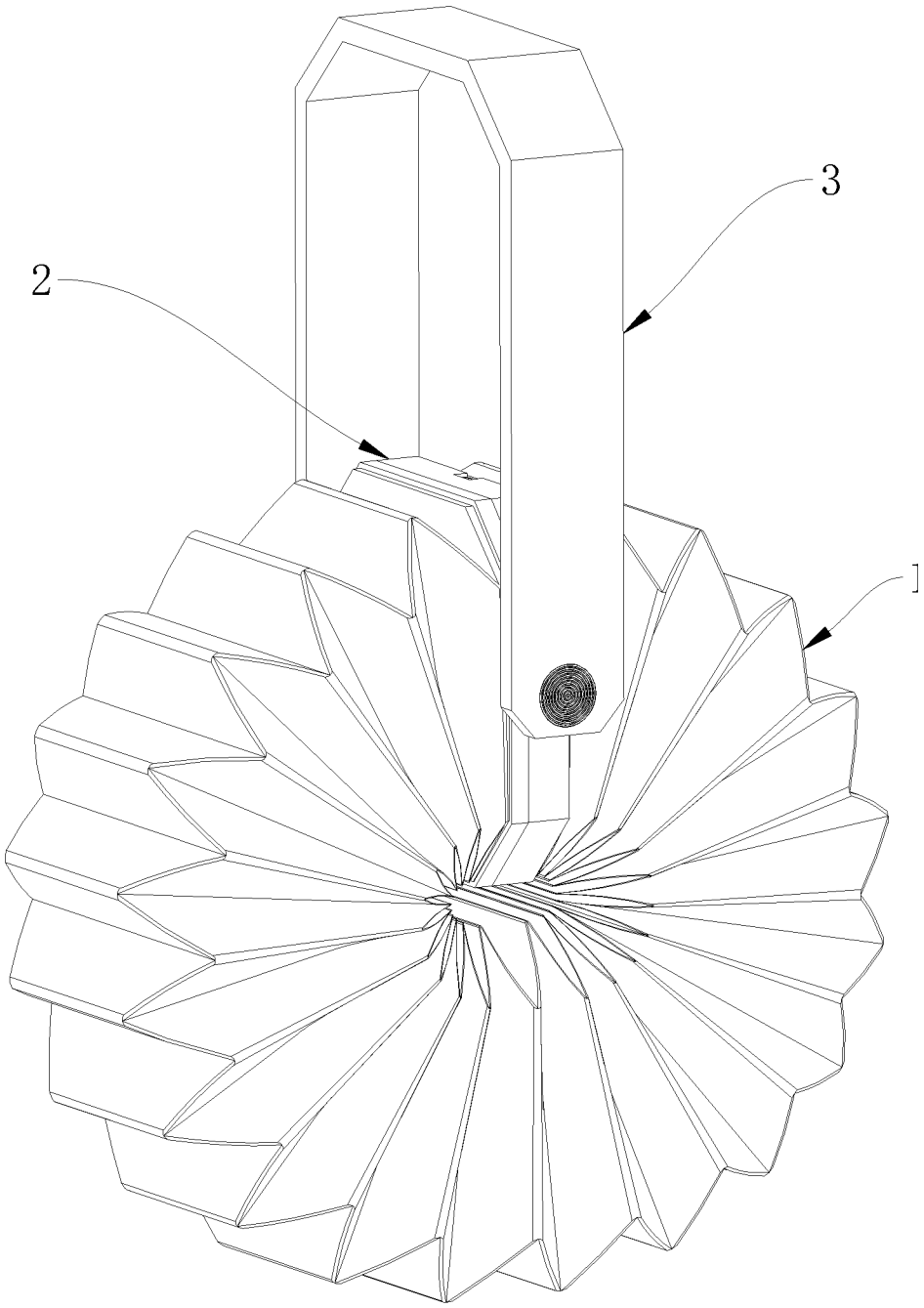
FIG. 14 is a perspective view of the portable lamp showing a ninth configuration thereof.

A fifth configuration of the portable lamp is shown in FIG. 10. FIG. 10 shows another semicircular shape of the adjustable lamp body 1. The positioning plate 22 is fitted to the desktop to support and position the adjustable lamp body 1.

Sixth, seventh, eighth and ninth configurations of the portable lamp are shown in FIGS. 11-14 respectively. These views show the ring shape of the adjustable lamp body 1 at different angles. When the positioning plate 22, the control box 21 and the adjustable lamp body 1 form a ring, it only needs to rotate the control box 21 to adjust the angle.

Figure 15:
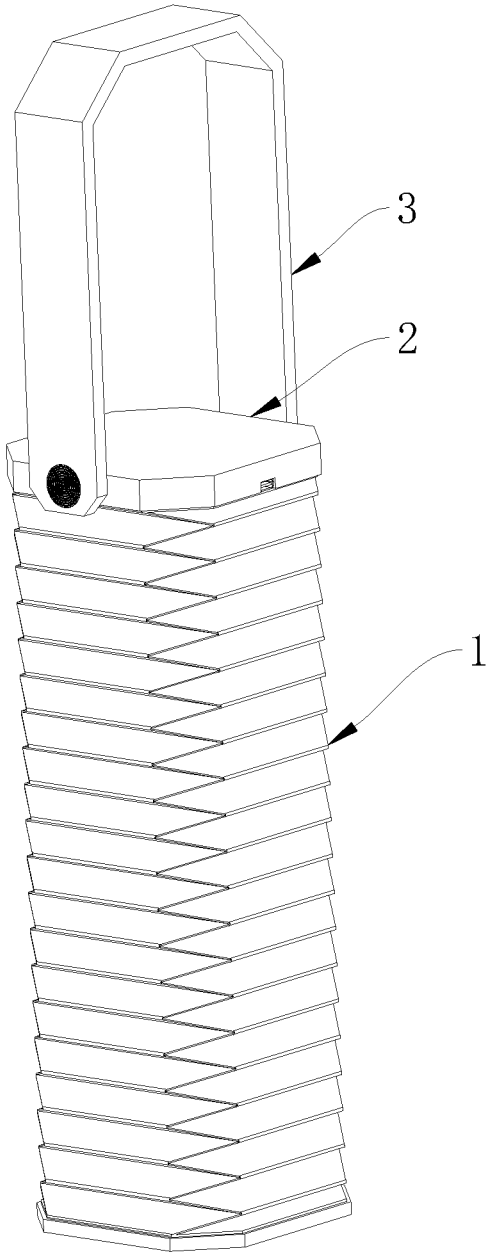
FIG. 15 is a perspective view of the portable lamp showing a tenth configuration thereof.

A tenth configuration of the portable lamp is shown in FIG. 15. FIG. 15 shows the unfolded state of the adjustable lamp body 1 at the bottom of the handle body 31. The user can use the product by holding the handle body 31.

To sum up, among the adjustable lamp body 1, lamp control assembly 2 and lamp positioning mechanism 3, the lamp positioning mechanism 3 adjusts the angle of the control box 21, and then adjusts the position of the positioning plate 22, so that different shapes of the adjustable lamp body 1 can be switched. Different from the common portable lamps on the market, the invention has various shapes. When not in use, the product can be folded to a very small size. The invention has the advantages of small space occupation, more portable use, simple and compact structure, good economic benefits and broad application prospects.

While the invention has been described in terms of preferred configurations, those skilled in the art will recognize that the invention can be practiced with modifications within the spirit and scope of the appended claims.

What is claimed is:

1. A portable lamp comprising:

an adjustable lamp body;

a lamp control assembly; and a lamp positioning mechanism;

wherein the adjustable lamp body is arranged on the lamp control assembly, and the lamp control assembly is arranged inside the lamp positioning mechanism;

wherein the adjustable lamp body comprises at least one folding part, and the folding part comprises two symmetrically arranged first outer folding parts and two symmetrically arranged first inner folding parts;

wherein the first inner folding parts are respectively arranged between two ends of each of the first outer folding parts;

wherein the lamp control assembly comprises a control box and a positioning plate respectively arranged at both ends of the adjustable lamp body;

further comprising a lamp belt having one end extending to inside of the adjustable lamp body, the lamp belt being arranged in the control box; and further comprising a handle body wherein two sides of an inner surface of the handle body are provided with positioning assemblies which are respectively connected to both ends of the control box so that the control box is configured to adjust and position an angle through the handle body.

2. The portable lamp of claim 1, wherein a plurality of the folding parts are combined with the lamp control assembly to form a ring shape, two adjacent ones of the first outer folding parts are combined to form a second inner folding part, and two adjacent ones of the first inner folding parts are combined to form a second outer folding part.

3. The portable lamp of claim 1, wherein an end of the lamp belt far from the control box runs through the adjustable lamp body and is connected to one side of the positioning plate.

4. The portable lamp of claim 1, further comprising a rechargeable battery and a control board electrically connected to the rechargeable battery; wherein the rechargeable battery and the control board are arranged inside the control box; wherein the control box comprises a charging interface electrically connected to the control board; and wherein an end of the lamp belt far from the positioning plate is fixedly arranged on the control board.

5. The portable lamp of claim 1, wherein the positioning assembly comprises a connecting pin fixedly arranged on both ends of the control box and a rubber tube embedded on both sides of the inner surface of the handle body; and wherein an end of the connecting pin far from the end of the control box extends to inside of the rubber tube and is movably sleeved with the inside of the rubber tube.

6. The portable lamp of claim 1, wherein the handle body is U-shaped, and wherein a side of the positioning plate far from the lamp belt is fitted with a side of the control box.

7. The portable lamp of claim 1, wherein the positioning plate and the control box are made of wood, metal, magnetic or plastic material.

8. The portable lamp of claim 1, further comprising a metal boss on a top of the inner surface of the handle body for adsorption with the positioning plate.

9. The portable lamp of claim 1, wherein the control box is a polygon, further comprising a plurality of beveled edges on both sides of the top of the handle body, and wherein a shape of the top of the inner surface of the handle body matches a shape of the top of the control box.

10. The portable lamp of claim 1, wherein the folding part is made of PVC, cardboard, cloth or TYVEK material; and wherein the handle body is made of wood, metal or plastic material.

* * * * *